US008278605B2

(12) United States Patent
Lollar

(10) Patent No.: US 8,278,605 B2
(45) Date of Patent: Oct. 2, 2012

(54) MULTIPLE STAGE OPEN COIL ELECTRIC RESISTANCE HEATER WITH BALANCED COIL ARRANGEMENT AND HEATER COOL END TERMINATION AND METHOD OF USE

(75) Inventor: James Patrick Lollar, Baxter, TN (US)

(73) Assignee: Tutco, Inc., Cookeville, TN (US)

( * ) Notice: Subject to any disclaimer, the term of this patent is extended or adjusted under 35 U.S.C. 154(b) by 1105 days.

(21) Appl. No.: 12/219,490

(22) Filed: Jul. 23, 2008

(65) Prior Publication Data

US 2009/0139985 A1 Jun. 4, 2009

Related U.S. Application Data

(63) Continuation-in-part of application No. 11/987,542, filed on Nov. 30, 2007, now Pat. No. 7,947,932.

(51) Int. Cl.
*H05B 3/06* (2006.01)
*H01C 3/14* (2006.01)

(52) U.S. Cl. ..... 219/532; 219/536; 219/537; 219/541; 219/552; 219/476; 219/477; 219/478; 338/304; 338/305; 338/319; 338/320; 338/299; 29/428

(58) Field of Classification Search ..... 219/532, 219/536–537, 535, 541, 552, 476–478; 338/304–305, 319–320, 299; 29/428
See application file for complete search history.

(56) References Cited

U.S. PATENT DOCUMENTS

| | | | | |
|---|---|---|---|---|
| 5,329,098 | A | 7/1994 | Howard et al. | |
| 5,895,597 | A | 4/1999 | Sherrill | |
| 5,925,273 | A | 7/1999 | Sherrill | |
| 7,075,043 | B2 * | 7/2006 | Howard et al. | 219/548 |
| 7,154,072 | B2 | 12/2006 | Sherrill et al. | |

* cited by examiner

*Primary Examiner* — Shawntina Fuqua
(74) *Attorney, Agent, or Firm* — Clark & Brody

(57) ABSTRACT

A multiple stage open coil electrical resistance heater uses a unique coil configuration on either side of a dividing support plate so that the air passing through the heater is heated uniformly when one or more stages of the heater are energized. The coil configuration also creates a termination zone on one side of the heater so that the terminations of the coils can be situated on the cool side of the heater. The heater coils also includes specially configured terminals to facilitate connection to power using an elongated member such as a stud or bolt.

14 Claims, 6 Drawing Sheets

MULTIPLE STAGE OPEN COIL ELECTRIC RESISTANCE HEATER WITH BALANCED COIL ARRANGEMENT AND HEATER COOL END TERMINATION AND METHOD OF USE

This is a continuation in part of application Ser. No. 11/987,542, filed on Nov. 30, 2007 now U.S. Pat. No. 7,947, 932, which is herein incorporated in its entirety by reference.

FIELD OF THE INVENTION

The present invention is directed to a multistage open coil electric resistance heater and method for use, and in particular, to a multistage heater configuration whereby the coil run of each stage is evenly arranged on either side of a dividing plate of the heater, the terminations of the coil runs are at the cool end of the heater, and the termination is particularly configured to accommodate threaded bolt or stud connections.

BACKGROUND ART

The use of a single resistance wire formed into a helical coil for use in electric resistance heating either for heating moving air, for radiant heating, or for convection heating is well known in the prior art. In one type of heater, the resistance coils are energized to heat air passing over the coils, the heated air then being directed in a particular manner for heating purposes. One application using such a heater is an electric clothes dryer.

Examples of open coil heaters are found in U.S. Pat. Nos. 5,329,098, 5,895,597, 5,925,273, 7,075,043, and 7,154,072, all owned by Tutco, Inc. of Cookeville, Tenn. Each of these patents is incorporated by reference in its entirety herein. One type of an open coil electric resistance heater is a two stage heater described in U.S. Pat. No. 7,075,043. A side view of this type of heater is shown in FIG. 1 and designated by the reference numeral 10. The heater 10 has two heater elements 10*a* and 10*b*, optimally for use in a clothes dryer. The elements 10*a* and 10*b* are supplied with electricity via terminals 12 extending from the terminal block 28. The heater elements 10*a*, 10*b* are supported by a support plate 14, which in turn supports a plurality of support insulators 16, typically made of ceramic material and which are well known in the art. The support insulators 16 support and isolate coiled portions of the elements, 10*a* and 10*b*, during operation of the heater.

The heater 10 includes opposing sidewalls (one shown as 6 in FIG. 1), wherein projections in the plate 14 extend through slots 20 in the sidewall 6 to allow the sidewalls to support the plate.

Each of the electric heater elements, 10*a* and 10*b*, is arranged in series of electrically continuous coils which are mounted on the plate 14 in a spaced-apart substantially parallel arrangement. Each heater assembly 10*a* and 10*b* is arranged substantially equally and oppositely on both sides of the plate. Crossover portions 22*a* and 22*b* of each heater element 10*a* and 10*b* are provided wherein each crossover links one coil of each of the elements mounted on one side of the plate 14 with another coil of the same element found on the other side of the plate.

Electricity is supplied to the heater assembly through the terminal block 28. The heater elements, 10*a* and 10*b*, are arranged so that the terminal connector portions or wire leads 32 and 34 which extend from an end 38 of each of the mounted coil sections to the terminal block are as short as possible. This aids in eliminating or reducing the need for supporting the connector portions. For the longer runs, the wire leads, 32 and 34, are partially enclosed with an insulating member 36. The insulating member 36 may be formed from any type of insulating material suitable for this purpose, e.g., a ceramic type. The insulating member is generally tubular in shape and rigid.

Another type of heater manufactured by Tutco, described in U.S. patent application Ser. No. 11/987,542 (herein incorporated by reference) is an improvement over the heater shown in FIG. 1, in that the heater coils are parallel to air flow to minimize noise, prevent coil "shadowing, and promote heat transfer from the heater coils to the air stream.

In the manufacture of appliances and equipment, especially clothes dryer manufacture, that require open coil electric heaters mounted in an air duct to heat air flowing through the duct, there is a constant need to provide an inexpensive method of making an electric heater having multiple stages of heat such that each stage provides some heat to each side of a support plate. In the prior art of open coil heaters having heater coils supported by ceramic insulators held in metal plates, one method of providing two stages of heat is to have one heater coil completely assembled on one side of the plate and the second coil on the opposite side, see U.S. Pat. No. 7,154,072. Upon energizing the first stage of heat, only the air on one side of the plate is heated making for a less than desirable heat distribution for the first heating stage.

Another method to improve heat distribution is to route the first stage coil so a portion of the heater coil is on one side of the support plate with the remainder of the coil routed on the opposite side, see U.S. Pat. No. 7,075,043 as one example. When these types of heaters are energized, heat is supplied to both sides of the duct during first stage heating. The second heat stage coils are similarly assembled to complement the first stage. This is an expensive design, as the ends of the heating element wire must be covered with special designed ceramic tubes or ceramic beads for electrical isolation to prevent grounding or reduction of electrical clearance, see the insulating members 36 in FIG. 1 as an example. Some designs use special designed ceramics to secure the heating element wire ends to prevent shorting, grounding or the reduction in electrical clearance as the wires are routed to terminals. A well accepted method long used is to provide individual termination points located immediately adjacent to the element coil ends. This is an expensive alternative, as power connections must be routed to multiple locations. Also, it is often impractical as some terminal locations may require power connections be made in excessively hot areas resulting in rapid deterioration under heat. Therefore, there is a need in the industry for a two stage, open coil electric heater that is inexpensive and has an arrangement wherein the first stage of the heater heats both sides of the air duct with the second heating stage complementing the first.

In the prior art there are usually either threaded style bolts or studs or blade or quick connect termination for power connection. Crimp style terminals made of flat metal stock for blade or quick connect termination crimped around resistance ends is well known and is presently sold by the TYCO Corporation. In the prior art, it is a common practice when bolt and threaded stud terminal style terminals are required for power connection, that these terminals are attached to element wire ends by welding, crimping, or pressure connection.

Welding is usually done by first mechanically staking the element wire ends into a slot in the head of a terminal bolt and then welding the two together. Crimping heating element wire ends to threaded bolts is accomplished by creating a tube style opening in one end of threaded stud terminals, inserting the heating element wire ends into the tube openings, and then mechanically closing the tubes so as to create a crimp connection. The least desirable connections are pressure connections in which resistance wire coil ends are looped around terminal bolts or threaded studs, then "sandwiched" between a combination of washers and nuts, whereby subsequent tightening of the nuts create electrical connections.

In the prior art, heating elements made as above are routed and assembled into the intended positions with heavy termination bolts attached to the coil ends. When a common threaded terminal power connection is needed, as for two stage or other multiple stage heaters, common element wire ends share a common terminal bolt or stud. When this type of connection is needed, the various methods of connection described above are followed except two or more element wire ends are connected to the required common terminal. For the welded connection, two or more common element wire ends are placed in the terminal bolt slot, mechanically staked then welded as above. For the crimp method, two or more common element wire ends are placed into the tube opening and crimped as above. For the pressure connection method, two or more common element wire ends are looped together then "sandwiched" as above and the termination completed. Thus, for the three prior art termination methods above, at least one end each of heater wire elements of multiple stage heaters share at least one common terminal bolt.

A shortcoming with respect to the termination of heater coils is that when threaded stud or bolt style termination for heaters is needed, prior art methods require the heating element wire ends to be first secured to heavy and cumbersome terminal bolts; the coil and terminal bolt assembly routed and subsequently secured to the coil support insulators. If the pressure connection method is used so as to allow heating element coils to be first assembled into a heater and then to connect to terminal bolts or threaded studs, this process is cumbersome and labor intensive. Also pressure electrical connections depend too much on the manual skill and attention of the person performing the task unlike a mechanical connection and thus generally are avoided if possible.

When threaded style terminations are required in the industry, there is needed a means to first make secure electrical connections between resistance wire coil ends and lightweight, easy to handle connectors that can later be attached to the terminal bolts or threaded studs whichever is used.

The present invention responds to the needs identified above by providing an improved open coil electrical resistance heater. The improved heater configuration that overcomes the problems noted above, by especially providing equal proportioning of the heater stages on either side of the support plate dividing the heater while at the same time arranging the terminal portions of the heater coils in the same location of the heater to reduce the need for extra supports and/or insulation and improving the manner of termination involving these types of heaters.

SUMMARY OF THE INVENTION

It is a first object of the invention to provide an improved multiple stage open coil electrical resistance heater.

It is another object of the invention to provide a multiple stage open coil electrical resistance heater that uses specially-configured heater coils so that generally equal portions of the stages are arranged on either side of the support plate that divides the heater.

A further object of the invention is a multistage open coil electrical resistance heater that includes an improved termination configuration, from the standpoint of the termination with respect to the heater itself and the particulars of the termination for power connection.

Another object of the invention is a method of heating air using an open coil electrical resistance heater having the specially configured heating coils and/or termination arrangement.

Other objects and advantages will become apparent as a description of the invention proceeds. In satisfaction of the foregoing objects and advantages of the invention, in open coil electrical resistance heater subassemblies that have a support plate dividing the heater into at least two portions, at least two resistance wire coils, and a plurality of insulators mounted to the support plate along a defined path, wherein each insulator configured to provide support to a portion of the resistance wire coil. The invention is an improvement over these subassemblies by the at least two resistance wire coils being partitioned generally equally on each side of the support plate. The at least two resistance wire coils also configured with their terminal ends located at one end of the support plate. This one end is, in effect, the cool end of the heater containing the subassembly so that the terminals used to connect to the coil ends are not subjected to the heat generated by the coils.

Each of the at least two resistance wire coils can have a first terminal on one coil end and a second terminal on the other coil end. The first terminal can comprise a first end crimped to the one coil end and a second flat end with an opening sized to receive an elongate member of a terminal. This first terminal facilitates the connection to a power terminal that may use a threaded stud or bolt. In one mode, two thirds of each of the at least two resistance wire coils can be arranged on one side of the support plate.

Another mode of the invention has one side of the support plate supporting portions of the at least two resistance wire coils along a generally longitudinal path along a length of the support plate. The other side of the support plate can support remaining portions of the at least two resistance wire coils, wherein one of the at least two resistance wire coils follows a generally longitudinal path and includes two crossover portions and the other of the at least two resistance wire coils extends along two generally parallel longitudinal paths.

In yet another mode, one of the at least two resistance wire coils has its coil ends arranged on one side of the support plate with the other of the at least two resistance wire coils having one coil end on one side of the support plate and the other coil end on the other side of the support plate.

The heater subassembly can be part of a multistage open coil resistance heater, wherein the support plate is mounted to a heater duct that surrounds the at least two resistance wire coils to form a passage for flow of air to be heated by the at least two resistance wire coils. The heater duct can have a power terminal mounted on one end thereof and at least one of the terminal ends is an elongate member extending from the power terminal, wherein each of the at least two resistance wire coils has a first terminal on one coil end and a second terminal on the other coil end, the first terminal further comprising the first end crimped to the one coil end and the second flat end with an opening sized receiving the elongate member of the power terminal for connection to power.

The invention also entails the use of the heater and subassembly described above by heating air using an open coil electrical resistance heater for a given application.

The invention also entails the use of the unique terminal arrangement at the end of one of the coils for power terminal connection and the method of assembly wherein the unique terminals facilitate the assembly of the heater and power terminal connection.

BRIEF DESCRIPTION OF THE DRAWINGS

Reference is now made to the drawings of the invention wherein.

DESCRIPTION OF THE PREFERRED EMBODIMENTS

The invention offers advantages in the field of open coil resistance heaters in that the problems associated with complicated insulating and support arrangements for multiple stage heaters that are arranged symmetrically about a heater support plate are eliminated. The inventive heater also solves the problem when connecting the resistance wire coil ends to bolt or stud terminals for power connection.

In one embodiment, the invention is a duct mounted, open coil, multiple stage open coil electric heater using a support plate to retain insulators that in turn retain convolutions of a heating element coil. For two stage heaters, unlike the prior art heaters, a unique coil routing has the first stage of heat providing heat to both sides of a support plate so that the air stream on each side of the duct is heated. This unique routing requires neither special ceramic insulators for insulating the heating element wire end nor carefully separated termination points.

The second stage of heat has a similar routing to complement the first stage. All coil ends are located at one end of the heater plate making power lead routing as simple as possible. With this design, the power termination leads can be located at the lowest temperature or cool end of the heater minimizing deterioration by temperature.

A further feature of the invention is a special terminal for crimping to heating element wire ends. The inventive terminal has a hole for connecting to a threaded stud or bolt. By making the terminal small and lightweight, it can be crimped to the ends of coiled heating element wires adding little mass or volume to the coil ends. This permits the coil with the terminals attached thereto to be easily assembled in their intended location. The inventive terminals can be fitted either over the ends of threaded terminal studs or terminal bolts can be passed through the hole in the terminal. When the nuts are tightened the new terminal may be sandwiched between some combination of washers and nuts making a secure connection. The connection is electrically secure because the current passes from the resistance wire through the crimp, to the terminal, from the terminal to the washers and nuts and on the threaded stud or bolt with little resistance because of the excellent surface area and mass of the system.

Figure 1:
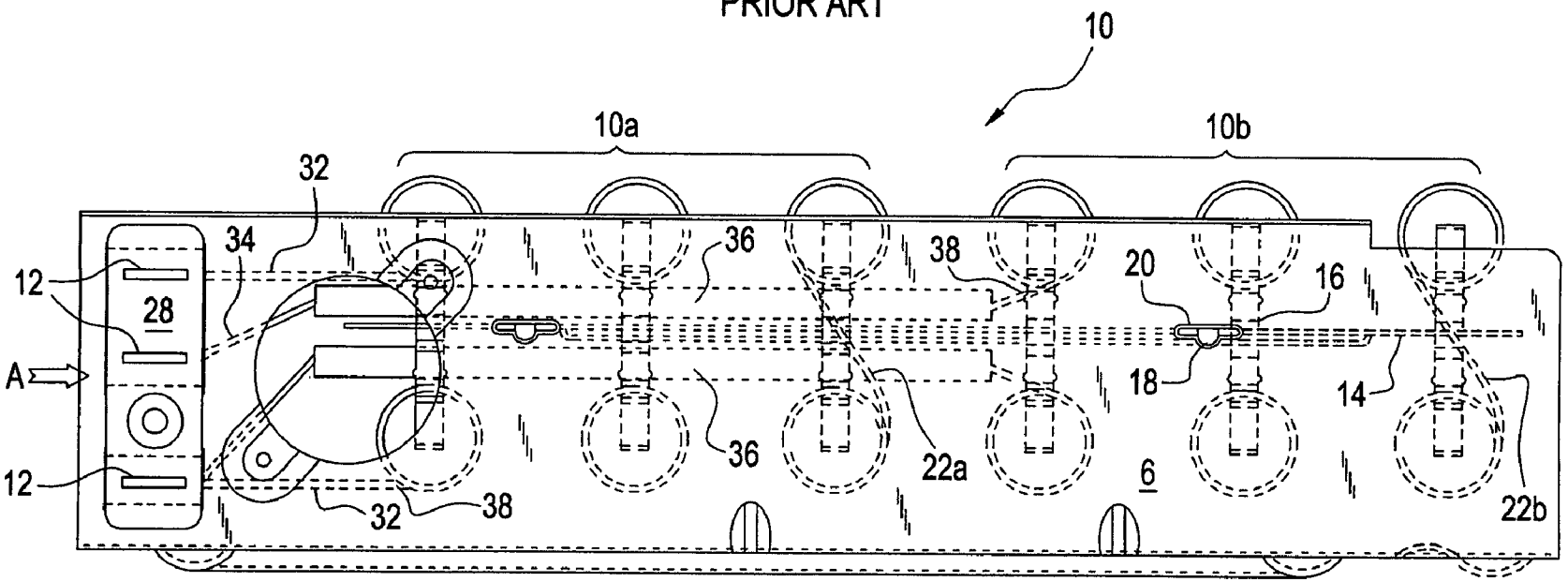
FIG. 1 PRIOR ART
FIG. 1 is a side view of a prior art open coil electric resistance heater.
Figure 2:
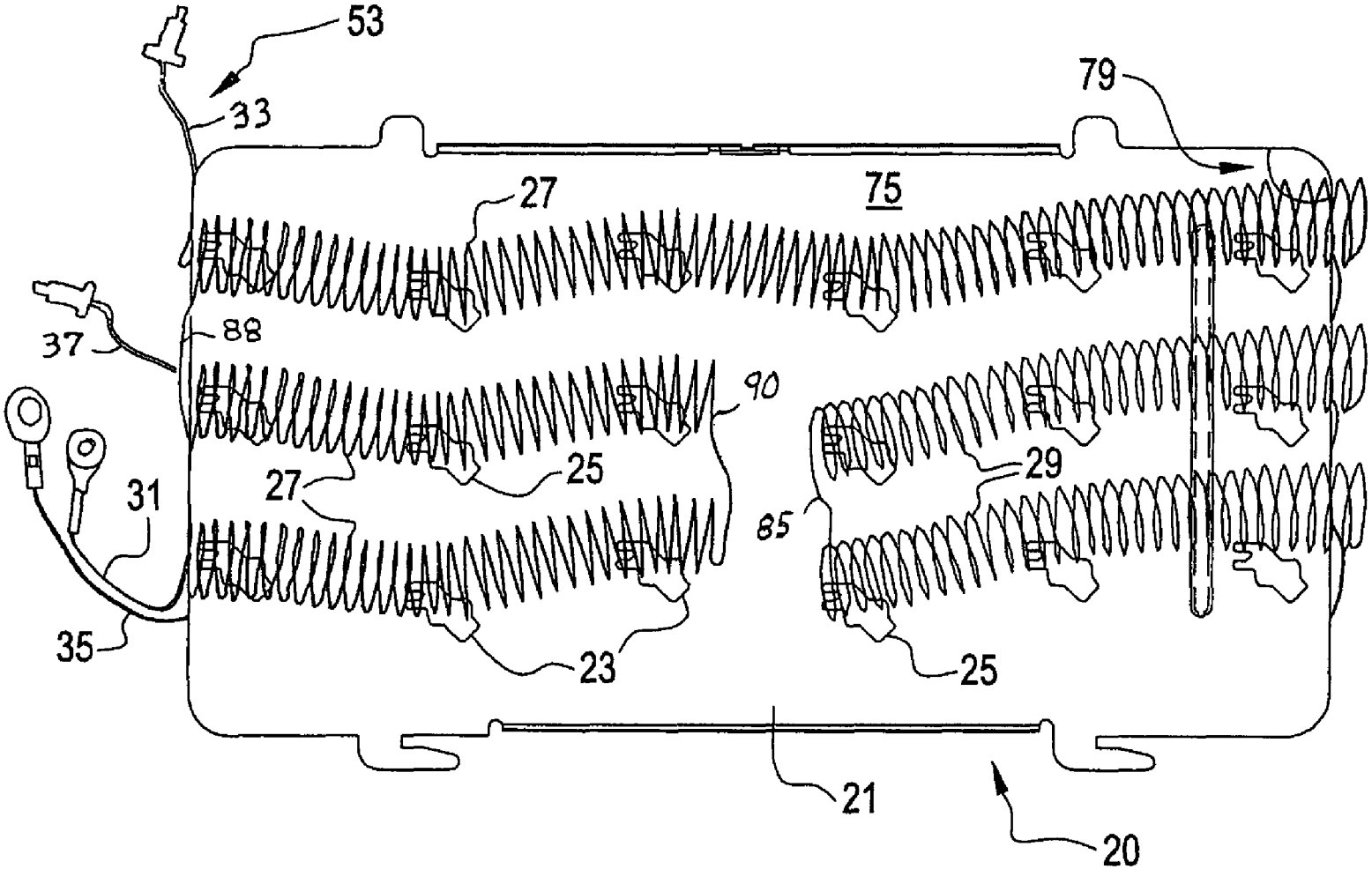
FIG. 2 is a top view of a support plate and coil arrangement depicting one embodiment of the inventive heater.
Figure 3:
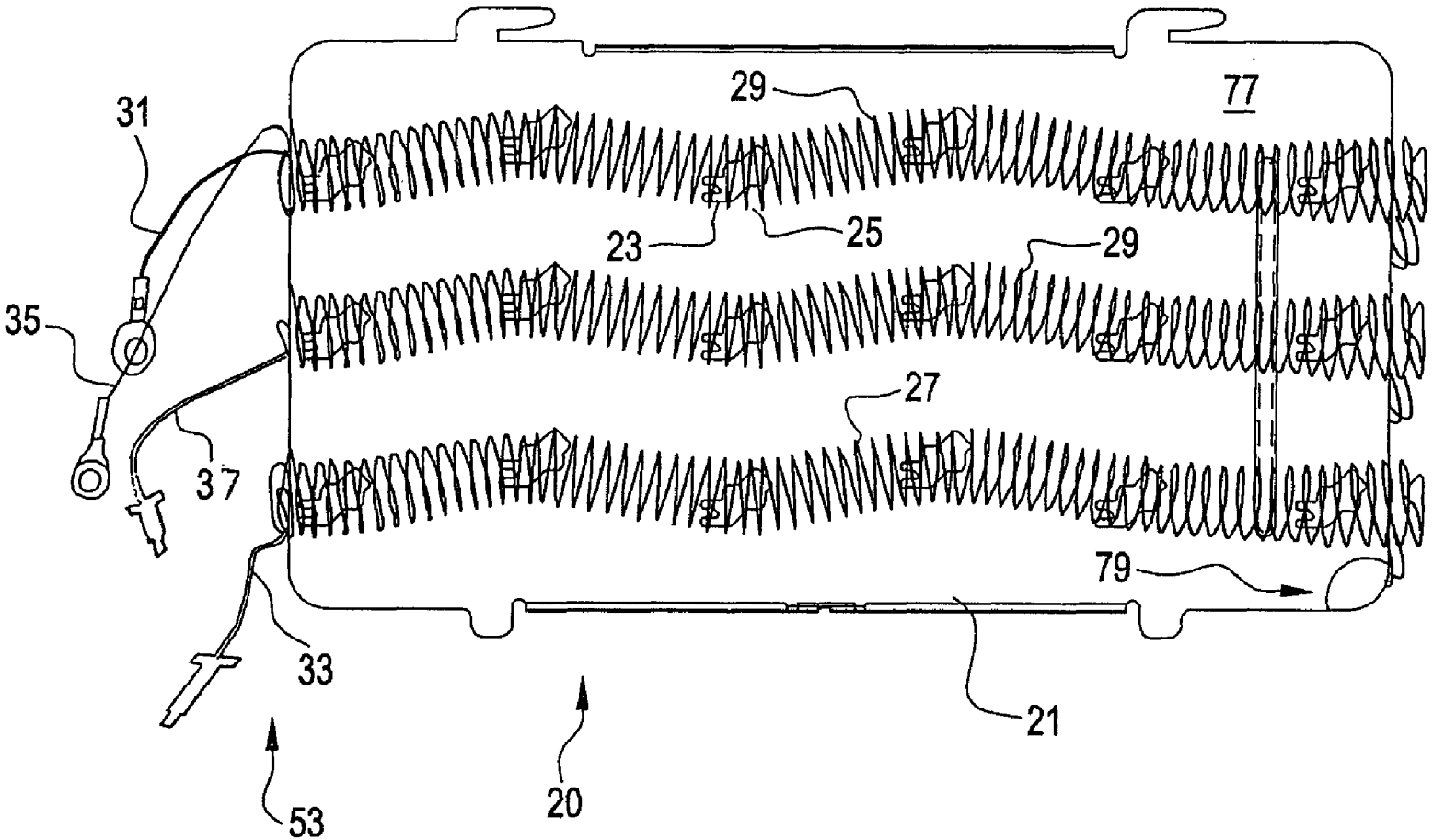
FIG. 3 is bottom view of the support plate of FIG. 2.
Figure 4:
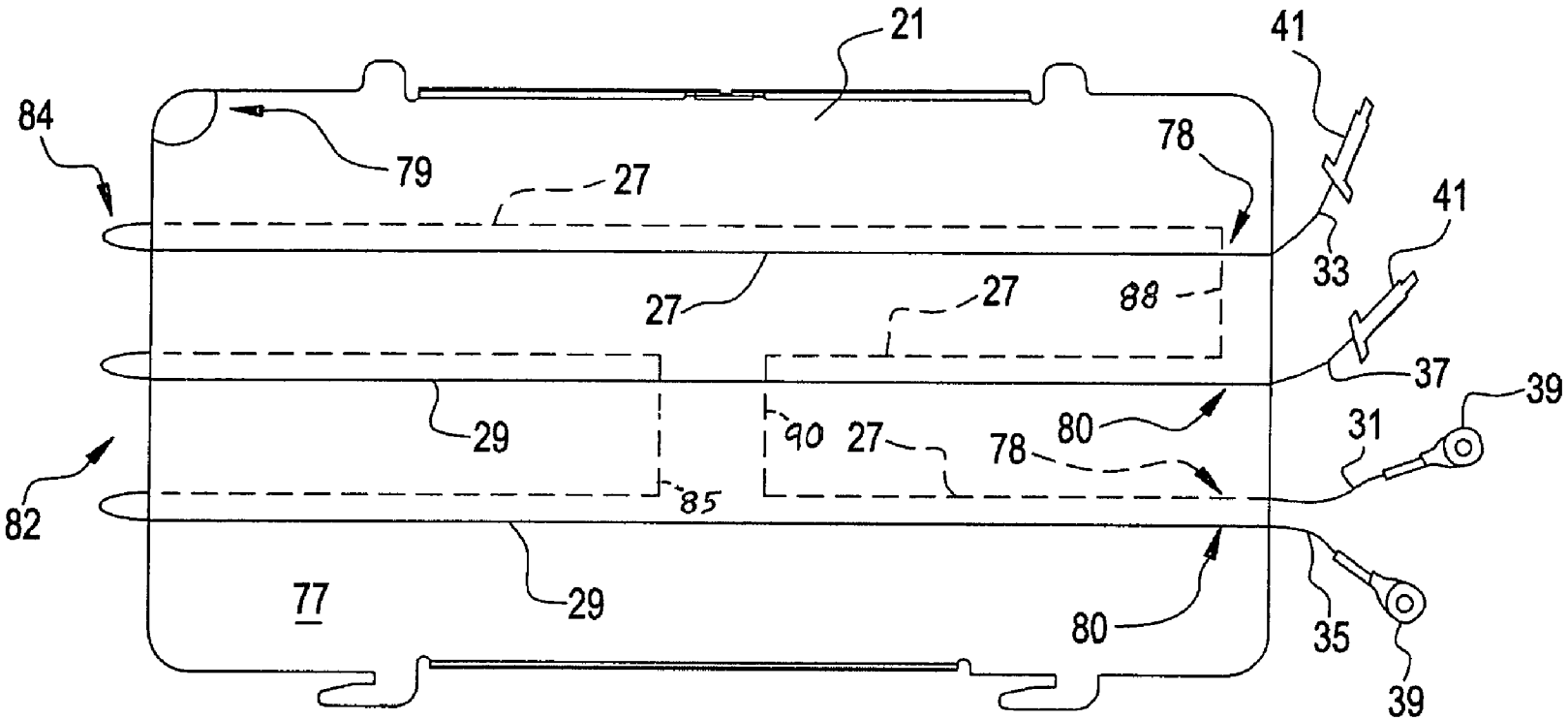
FIG. 4 is a schematic showing the arrangement of the coils depicted in FIGS. 2 and 3.
Figure 5:
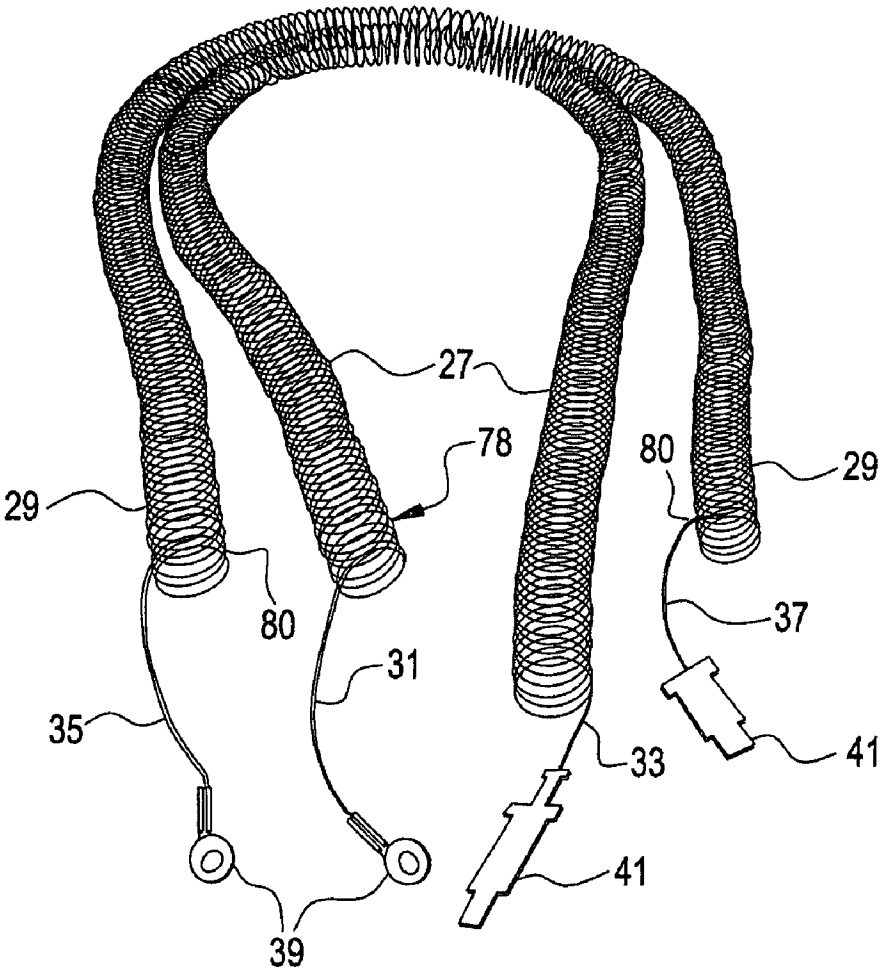
FIG. 5 shows the coils separated from the heater assembly for better clarity.

Referring now to FIGS. 2-4, a heater subassembly 20 as one embodiment of the inventive heater is disclosed. FIGS. 2 and 3 depict a support plate 21 as part of the subassembly 20. The support plate 21 has a number of openings 23, which are sized to retain insulators 25. The insulators 25 are configured to connect to and support the coils 27 and 29.

The heater assembly 20 is a two stage heater, although more stages could be employed if so desired. The two stage heating is accomplished by the pair of resistance wire coils 27 and 29, with coil 27 representing the first stage and coil 29 representing the second stage.

Coil 27 has opposing terminal ends 31 and 33, with coil 29 having opposing terminal ends 35 and 37. Terminal ends 31 and 35 have a first type of terminal 39 attached thereto. Terminal ends 33 and 37 have a second type of terminal 41 attached thereto. Terminal 41 is a conventional blade end crimp style terminal whereby the end of the resistance wire is crimped to one end of the terminal. The other end is a flat configuration for connection as is well known in the art. Since these blade end crimp type terminals are well known, a further description is not necessary.

Referring now to FIGS. 5 and 7*a*-7*c*, the terminal 39 has a crimp end 43 and flat end 45. The crimp end 43 includes a pair of flanges 47, with a slot 49 between the flanges. The slot 49 receives the end of the coil wire and the flanges 47 are crimped to form a tight connection between the coil wire end and crimp end 45. The flat end 45 has an opening 51 that is sized to receive a stud or bolt or other elongated terminal member for connection. As described above, the terminal 39 can hold a bolt during assembly of the heater, with the bolt making the power connection once the heater is finally assembled. In the alternative, the terminal 39 can be used once the heater is completely assembled to attach to a particular stud or bolt using the necessary combination of washers and nuts for a secure connection. Thus, the manufacture of the heater assembly has maximum capability when assembling the heater to accommodate different modes of assembly.

Figure 6:
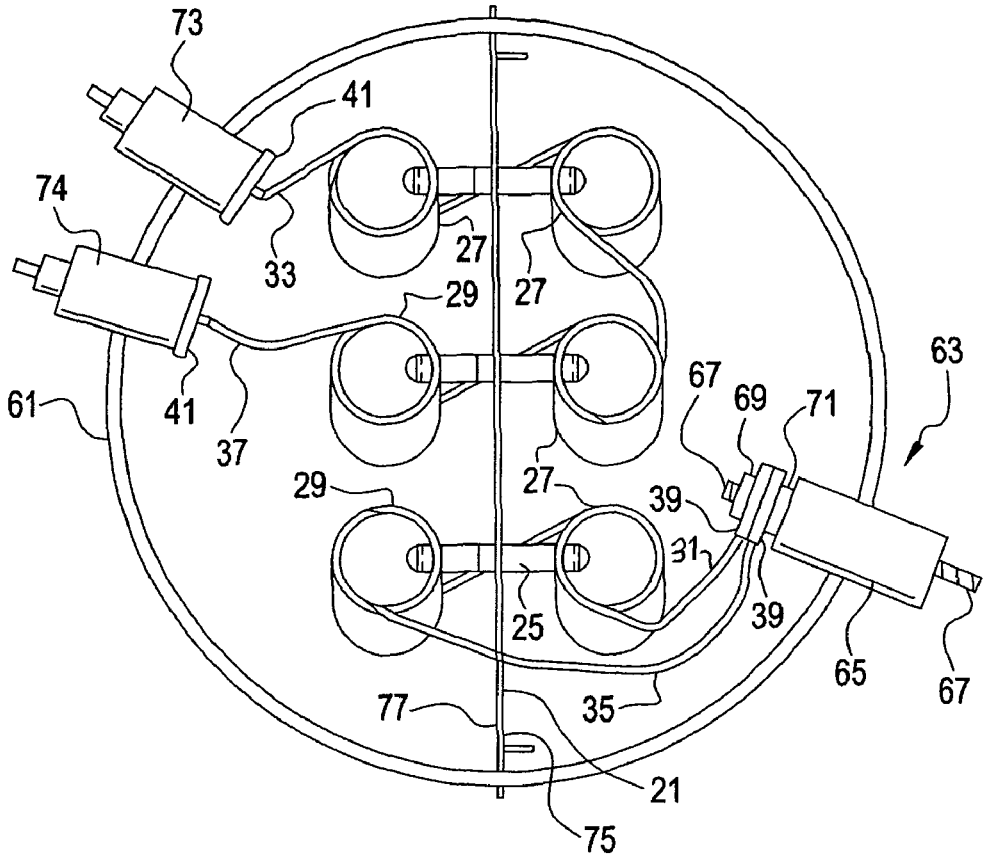
FIG. 6 is a schematic showing an exemplary termination arrangement for an assembled heater using the assembly of FIGS. 2 and 3.
Figure 7A:
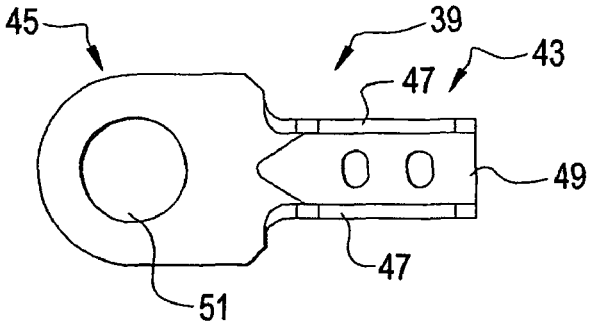
FIG. 7*a* is top view of the terminal shown in FIG. 5.
Figure 7C:
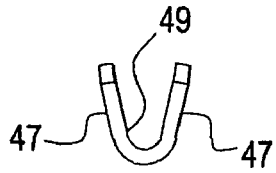
FIG. 7*c* is an end view of the terminal of FIG. 7*a*.
Figure 7B:
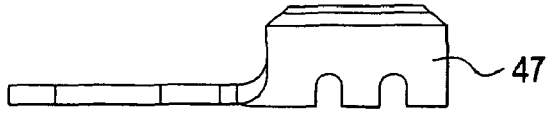
FIG. 7*b* is a side view of the terminal of FIG. 7*a*.

Referring now to FIGS. 2-4 and 6, the unique arrangement of the coils 27 and 29 produces a termination zone 53 of the coils at one end of the support plate 21. Referring to FIG. 6, one end of a completed heater 60 is shown. The heater 60 includes the support plate 21, insulators 25, and coils 27 and 29, and their respective terminals 39 and 41. The heater 60 includes a circular duct 61 (other shaped ducts could be used) that is linked to the support plate using openings in the duct and the protrusions on the support plate as is well known in the art. The support plate 21 divides the duct into two halves, but other plates could be used to create more sectors of the heater.

The heater 60 supports a power terminal 63, which includes a ceramic bushing 65, with elongated members, e.g., threaded studs 67, extending from each end. One stud 67 attaches to both terminals 39 of the coils 27 and 29 using nut 69 and washer 71 (other combinations of washers and nuts or other fasteners may be employed). The other stud 67 is attached to power. The blade terminals 41 are attached to two other terminals 73 and 74 as conventionally done for these types of heaters. The terminals 73 and 74 have connectors 76 opposite the connection to terminals 41 to complete the circuitry of the heater.

By the configuration of the coils and formation of the termination zone 53, the terminations of the coil ends are located at one end of the heater. By positioning this end into upstream of the flow of air (where ambient air is introduced into the heater), the termination zone is on the cool side of the heater so that the effects of heated air on the terminations is minimized. Also, the terminals are all in the same location, which makes it easier to routing wiring and installing the heater.

The unique configuration of the coils is best seen in FIGS. 2-4 and 6. FIG. 2 represents the coils mounted to the side 75 of the support plate 21 (shown as the right side of the heater of FIG. 6) with FIG. 3 showing the coils mounted to the side 77 of the support plate 21 (shown as the left side of the heater of FIG. 6). For ease of understanding, the sides 75 and 77 each have a reference mark 79.

On side 77, it can be seen that there are two runs of the second stage coil 29 and one run of the first stage coil 27. On the opposite side 75, there is one full run and two half runs of the first stage coil 27, and two half runs of the coil 29. This configuration means that when the first stage heater is used, air passing on both sides 75 and 77 of the support plate is heated. Similarly, during a two stage heating, air passing on both sides is heated from both coils 27 and 29. If the runs on each side were considered to be in thirds, side 77 has two thirds of the coil 29 and one third of the coil 27, with side 75 having two thirds of the coil 27 and one third of the coil 29.

FIG. 4 shows the runs of coils in one drawing, which more clearly depicts the crossovers between the plate 21 and crossovers between coils 27 and 29 on each side of the plate 21. For side 77, coil 29 has both ends 80 of the coil portion (see FIG. 5 to more clearly see the end of the coil portion of the coil) terminate on side 77, with the two runs linked by crossing over at crossover portion 82 to the two half runs on side 75, which are linked by crossover portion 85.

Coil 27 has one coil end 78 terminate on side 77, with one crossover at crossover portion 84 to side 75 to another long run. The long run on side 75 links to one of the short runs on the same side by crossover portion 88, which in turn links to another short run on the same side by another crossover portion 90 so that the coil end terminates on side 75 at end 31 and terminal 39. While the free and uncoiled ends of the coils 27 and 29 could cross over the support plate 21 to attach to the desired terminal as shown in FIG. 6 for coil end 35, the ends of the coils themselves, i.e., 78 and 80, are separated by the support plate 21.

FIGS. 2 and 3 also show the runs of the coils 27 and 29 in a sinusoidal pattern or configuration. Each of the resistance wire coil 27 and 29 has a longitudinal axis generally parallel to an air flow path of the heater. At least a portion of the insulators 25 that support the coils 27 and 29 are offset from the path. These offset insulators 25 when combined with the insulators 25 on the path cause at least a portion of the resistance wire coil to have a sinusoidal shape as disclosed in application Ser. No. 11/987,542 noted above. It is this sinusoidal shape that provides advantages in terms of noise reduction, reduction of the shadowing problem, minimizing vibration resonancy, and better filling the volume of the heater for maximized heat transfer. While this sinusoidal shaped coil configuration is a preferred one, other coil configurations could be employed such as a straight configuration that has no sinusoidal pattern.

While the disclosed embodiment shows a particular arrangement of terminals for each side of the plate 21, the terminals 39 and 41 could be switched if the terminations on the heater duct dictated such a switch.

It should be also understood that the unique configuration of the coils and creation of the termination zone 53 can be used with any types of terminals for the ends 31, 33, 35, and 37 of the coils. Also, while a two stage heater is shown, additional coils could be employed without departing from the equal partitioning of the coils for each stage on each side of the plate and maintaining termination at the cool or upstream end of the heater. The support plate 21 is typically metal in these types of heaters, but it can be any material capable of providing the desired strength and stability during the heater operation, a non-metallic material, composite and the like. The other heat components can also be made of any materials that are capable of functioning in the environment of open coil resistance heaters.

In use, the heater of the invention can be used to heat air passing over the coils in the known fashion. Also, the inventive terminal configuration allows the terminals 39 to be attached to one end of the coil prior to heater assembly or during an early stage of the assembly. The lightweight nature of the terminal avoids the problem encountered when heavy bolts have been used in the past. The use of the terminal 39 enables a secure termination at the power terminal to be easily made using nuts and washers.

As such, an invention has been disclosed in terms of preferred embodiments thereof which fulfills each and every one of the objects of the present invention as set forth above and provides a new and improved multiple stage open coil resistance heater with specially configured coils and termination arrangement and a method of heating using the specially configured coil.

Of course, various changes, modifications and alterations from the teachings of the present invention may be contemplated by those skilled in the art without departing from the intended spirit and scope thereof. It is intended that the present invention only be limited by the terms of the appended claims

What is claimed is:

1. In an open coil electrical resistance heater subassembly having a support plate dividing the heater into at least two portions, at least two resistance wire coils, a plurality of insulators mounted to the support plate along a defined path, each insulator configured to provide support to a portion of the resistance wire coil, the improvement comprising the at least two resistance wire coils partitioned generally equally on each side of the support plate, the at least two resistance wire coils each having first and second coil ends with a lead extending from each of the first and second coil ends, wherein each of the first and second coil ends are located at one end of the support plate.

2. The subassembly of claim 1, wherein each of the at least two resistance wire coils has a first terminal on one coil end and a second terminal on the other coil end, the first terminal further comprising a first end crimped to the one coil end and a second flat end with an opening sized to receive an elongated member of a terminal.

3. The subassembly of claim 1, wherein two thirds of each of the at least two resistance wire coils are arranged on one side of the support plate.

4. The subassembly of claim 1, wherein one side of the support plate supports portions of the at least two resistance wire coils along a generally longitudinal path along substantially the entire length of the support plate.

5. The subassembly of claim 4, wherein the other side of the support plate supports remaining portions of the at least two resistance wire coils, wherein one of the at least two resistance wire coils follows a generally longitudinal path and includes two crossover portions and the other of the at least two resistance wire coils extends along two generally parallel longitudinal paths.

6. The subassembly of claim 1, wherein one of the at least two resistance wire coils has its coil ends arranged on one side of the support plate with the other of the at least two resistance wire coils having one coil end on one side of the support plate and the other coil end on the other side of the support plate.

7. The subassembly of claim 5, wherein one of the at least two resistance wire coils has its coil ends arranged on one side of the support plate with the other of the at least two resistance wire coils having one coil end on one side of the support plate and the other coil end on the other side of the support plate.

8. In a heater having a subassembly having a support plate dividing the heater into at least two portions, at least two resistance wire coils, a plurality of insulators mounted to the support plate along a defined path, each insulator configured to provide support to a portion of the resistance wire coil, wherein the support plate is mounted to a heater duct that surrounds the at least two resistance wire coils to form a passage for flow of air to be heated by the at least two resistance wire coils, the improvement comprising the subassembly being the subassembly of claim 1.

9. The heater of claim 8, wherein the heater duct has a power terminal mounted on one end thereof and at least one of the terminal ends is an elongated member extending from the power terminal, wherein each of the at least two resistance wire coils has a first terminal on one coil end and a second terminal on the other coil end, the first terminal further comprising a first end crimped to the one coil end and a second flat end with an opening sized receiving the elongated member of the power terminal for connection to power.

10. An open coil electrical resistance heater comprising:

a) a duct of defined cross section;

b) a support plate supported by the duct to divide the duct into two portions;

c) at least two resistance wire coils adapted to connect to a power source for energizing of the heater;

d) a plurality of insulators, each insulator mounted to the support plate to support portions of the resistance wire coils;

e) wherein the at least two resistance wire coils are partitioned generally equally on either side of the support plate, each of the resistance wire coils having first and second coil ends with a lead extending from each of the first and second coil ends, wherein each of the first and second coil ends are arranged at one end of the heater.

11. In a method of heating air using an open coil electrical resistance heater, the improvement comprising using the multiple stage open coil electrical resistance heater of claim 8.

12. In an open coil electrical resistance heater subassembly having a support plate dividing the heater into at least two portions, at least two resistance wire coils, a plurality of insulators mounted to the support plate along a defined path, each insulator configured to provide support to a portion of the resistance wire coil, the improvement comprising each of the at least two resistance wire coils having a first terminal on one coil end and a second terminal on the other coil end, the first terminal further comprising a first end crimped to the one coil end and a second flat end with an opening sized to receive an elongated member of a terminal.

13. The subassembly of claim 12, wherein the first and second terminals of the at least two resistance wire coils being arranged at one end of the support plate.

14. In a method of assembling a heater using electric resistance wire coils, wherein a power terminal is attached to one end of each of the electric resistance wire coils used in the heater prior to assembly, the improvement comprising attaching a first terminal to the one end, the first terminal further comprising a first end crimped to the one coil end and a second flat end with an opening sized to receive an elongated member of a terminal.

* * * * *